US008215936B2

(12) United States Patent
Mosemann et al.

(10) Patent No.: US 8,215,936 B2
(45) Date of Patent: Jul. 10, 2012

(54) SCREW COMPRESSOR

(76) Inventors: Dieter Mosemann, Schildow (DE); Ottomar Neuwirth, Berlin (DE)

( * ) Notice: Subject to any disclaimer, the term of this patent is extended or adjusted under 35 U.S.C. 154(b) by 353 days.

(21) Appl. No.: 11/801,190

(22) Filed: May 9, 2007

(65) Prior Publication Data

US 2009/0016922 A1 Jan. 15, 2009

(30) Foreign Application Priority Data

Aug. 1, 2006 (DE) ..... 10 2006 035 783

(51) Int. Cl.
*F01C 1/16* (2006.01)
*F03C 2/00* (2006.01)
*F03C 4/00* (2006.01)

(52) U.S. Cl. ..... 418/201.1; 418/132; 417/452; 417/454

(58) Field of Classification Search ..... 418/201.1, 418/206.1, 206.7, 132; 384/452–455
See application file for complete search history.

(56) References Cited

U.S. PATENT DOCUMENTS 2,264,616 A * 12/1941 Buckbee ..... 418/131
4,443,170 A 4/1984 Schibbye
RE32,055 E * 12/1985 Schibbye et al. ..... 418/98
5,096,399 A 3/1992 Mosemann
5,393,209 A * 2/1995 Mohr et al. ..... 418/202
5,927,863 A * 7/1999 De Bock ..... 384/468
6,519,967 B1 2/2003 Mosemann et al.
6,848,891 B2 * 2/2005 Dieterich ..... 418/201.1

OTHER PUBLICATIONS

U.S. Appl. No. 11/801,188, filed May 9, 2007, Mosemann et al.

* cited by examiner

*Primary Examiner* — Theresa Trieu
(74) *Attorney, Agent, or Firm* — Horst M. Kaspar

(57) ABSTRACT

In screw compressors for extremely high discharge pressures, the geometrical centers of all coaxial holes or housing bores are all located in one single housing section on the male rotor side at a certain first straight line and the geometrical centers of all coaxial holes or housing bores are all located in one single housing section on the female rotor side at a certain second straight line. The diameter of all coaxial holes in the housing on the male rotor side, and the diameters of all coaxial holes in the housing on the female rotor side, decrease from the open to the closed end of the housing section. Based on this construction, the bearings and the components adjacent to the bearings are guided at their periphery in one single housing section so that there will be no coaxial deviations caused by assembly and no coaxial deviations in long term operation.

20 Claims, 4 Drawing Sheets

SCREW COMPRESSOR

BACKGROUND OF THE INVENTION (1) Field of the Invention

The invention relates to a screw compressor for compressing a working fluid to an extremely high discharge pressure featuring two rotors, a male rotor having essentially convex-shaped lobe flanks with at least four lobes and a female rotor with the male rotor having a drive-shaft end, and both rotors are enclosed in a housing featuring at least an inlet port for passing of the working fluid into the lobes of the rotor pair and at least an outlet port for forcing the gas out of the interlobe spaces of the rotor pair due to rotation of the rotors.

(2) Description of Related Art Including Information Disclosed Under 37 CFR 1.97 and 1.98

The profile sections of the rotors have shaft shoulders enclosed in radial bearings. There is one bearing per each side of the profile section. The resulting axial forces are being supported by axial bearings.

The profile section of the rotors is extremely short. The axial length of the profile section of the rotor pair corresponds to approx. 1,4 the value of the axial lobe pitch which corresponds to the axial distance between two lobe-flank points of neighbouring lobe flanks. Known compressors have several housing sections accommodating the bearings of the rotors. These housing sections are connected with each other by suitable means after having been fixed at reference points. (U.S. Pat. No. 4,042,310, U.S. Pat. No. 4,004,864, U.S. Pat. No. 4,084,405, U.S. Pat. No. 4,455,131, U.S. Pat. No. 4,597,726, U.S. Pat. No. 4,748,831)

This configuration leads to impermissible inclined positions of the bearings, if there are rotors with very short profile sections as the axial distance between the radial bearings arranged on both sides of the rotors is very short.

This has an impermissible impact on both the service life and load-carrying capacity of the bearings. The essence of the invention is that the housing section, which encloses the profile section of the rotors, is cup-shaped and that the adjacent outer diameters of the parts arranged in this housing section decrease when going from the open to the closed end of the housing section and that all the parts can be mounted from one side of the housing.

BRIEF SUMMARY OF THE INVENTION

The feature of the invention is that all built-in components enclosing the rotors are arranged in enclosing bores in the housing; the centers of which are all arranged on two parallel axes of the housing. Built-in components are the radial bearings on the suction side, and the radial bearings on the discharge side arranged in concentric supporting flanges. Due to this configuration, the bearings and the components adjacent to the bearings are guided at their periphery in the same housing so that there will be no coaxial deviations from a coaxial position of the rotor caused by assembly.

The screw compressor according to the invention for extremely high discharge pressures up to 160 bar of a working fluid comprises male rotor with a drive-shaft end and a female rotor. The profile sections of both rotor gaps are forming v-shaped working chambers by surrounded housing bores. The housing is enclosing the male rotor and the female rotor. The housing has an inlet port connected for passing the working fluid into the cavities, has an outlet port for discharging gas out of the cavities due to rotation of the rotors.

A rotor pair for a screw compressor according to the invention is characterized by wrap angle of the male rotor of about 100 degrees, by a teeth ratio between male and female teeth of 5:6, by teeth index angle between neighboring teeth of the male rotor of 72 degrees; by relative small rotor profile length relative to rotor diameter.

The profile section of the male rotor attaches shaft shoulders. The profile section of the female rotor attaches shaft shoulders.

Radial bearings on a suction side are enclosing the shaft shoulders. Radial bearings on a discharge side are enclosing the shaft shoulders. Axial bearings attaches to the radial bearings on the discharge side for supporting resulting axial forces.

Supporting flanges are disposed adjacent to the radial bearings and guided at their periphery in the housing such that no coaxial deviations will arise caused by assembly.

End housing fixes the supporting flanges in axial direction.

Advantageously the assembling of supporting flanges, male and female rotor and bearings is possible without alignment and without adjustment from one side of the housing.

BRIEF DESCRIPTION OF THE SEVERAL VIEWS OF THE DRAWING(S)

The FIG. 1 shows a screw compressor according to the invention.

Figure 1:
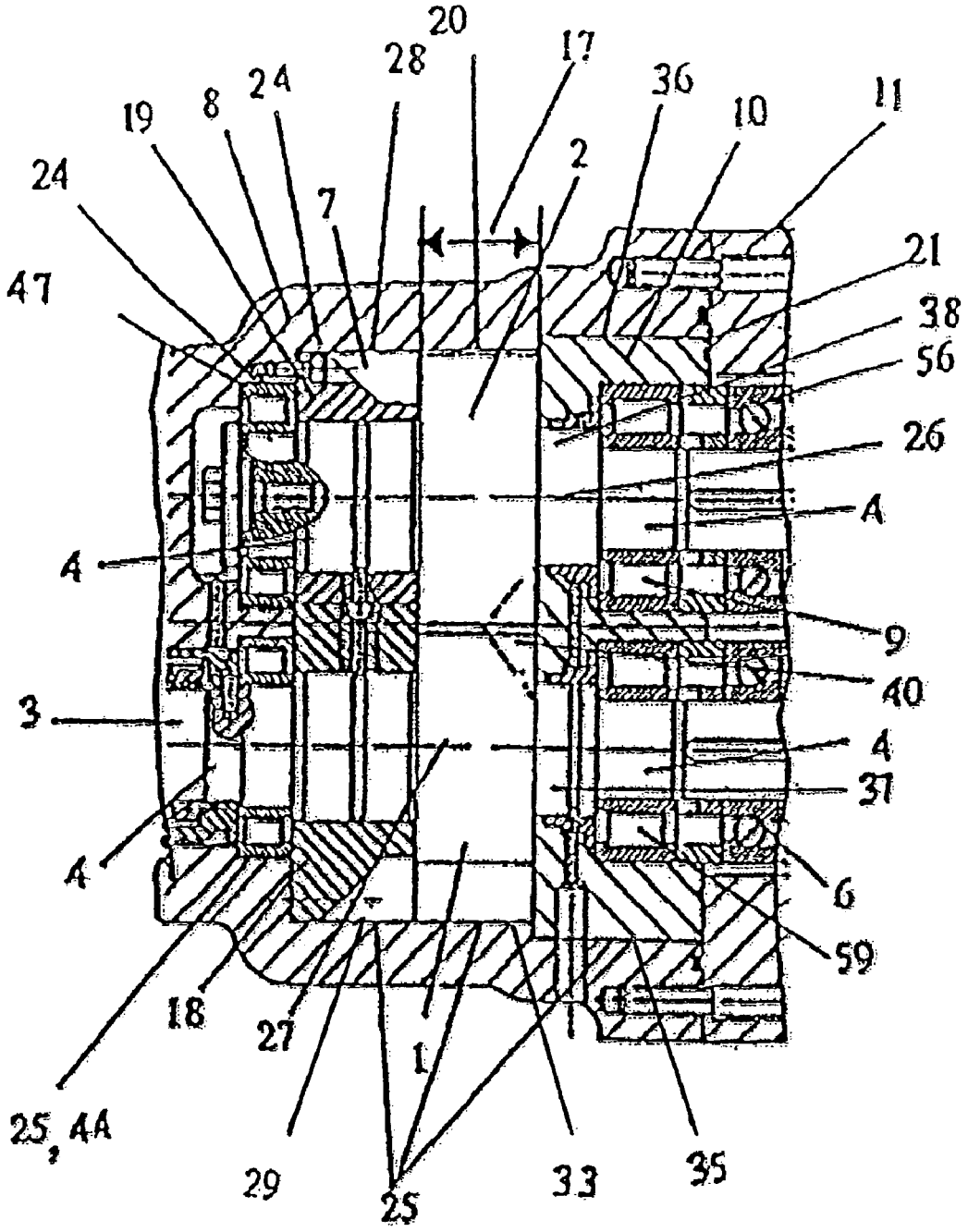

The housing 8 enclosing the male rotor 1 and the female rotor 2 has an inlet port 7 for passing the working fluid into the cavities and has an outlet port 40 for discharging gas out of the cavities due to rotation of the rotors 1,2. The male rotor 1 has the profile section and shaft shoulders 4. The female rotor 1 has a female profile section and shaft shoulders 4. Radial bearings 5 on a suction side are enclosing the shaft shoulders 4; radial bearings 9 on a discharge side are enclosing the shaft shoulders 4; axial bearings 6 are attached to the radial bearings 9 on the discharge side for supporting resulting axial forces.

Supporting flanges 10 are disposed adjacent to the radial bearings and are guided at their periphery in the housing 8 such that no coaxial deviations will arise caused by assembly. The end housing 11 is fixing the supporting flanges in axial direction.

Figure 2:
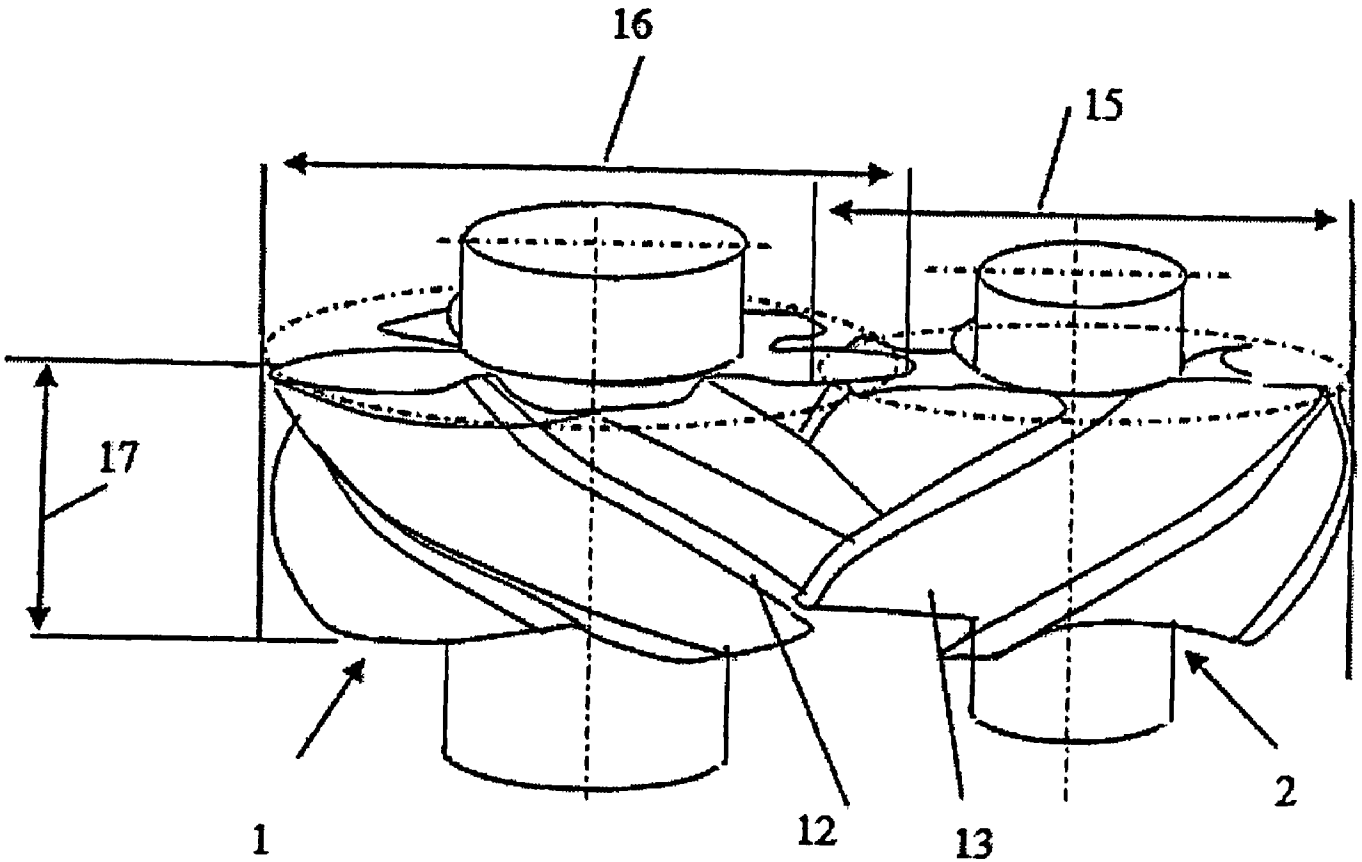
FIG. 2 shows a rotor pair of a screw compressor according to the invention.

The rotor pair shown at FIG. 2 is characterized by very short profile part.

The rotor profile length 17 is short relative to the male rotor diameter 16.

The teeth ratio between male and female teeth number is 5:6. It comprises the male rotor 1 with a wrap angle of about 100 degrees.

The teeth index angle between neighboring teeth of the male rotor 1 is 72 degrees. The female rotor diameter 15 is smaller than the diameter 16 of male rotor 1. Male rotor 1 and female rotor 2 are forming cavities.

Figure 3:
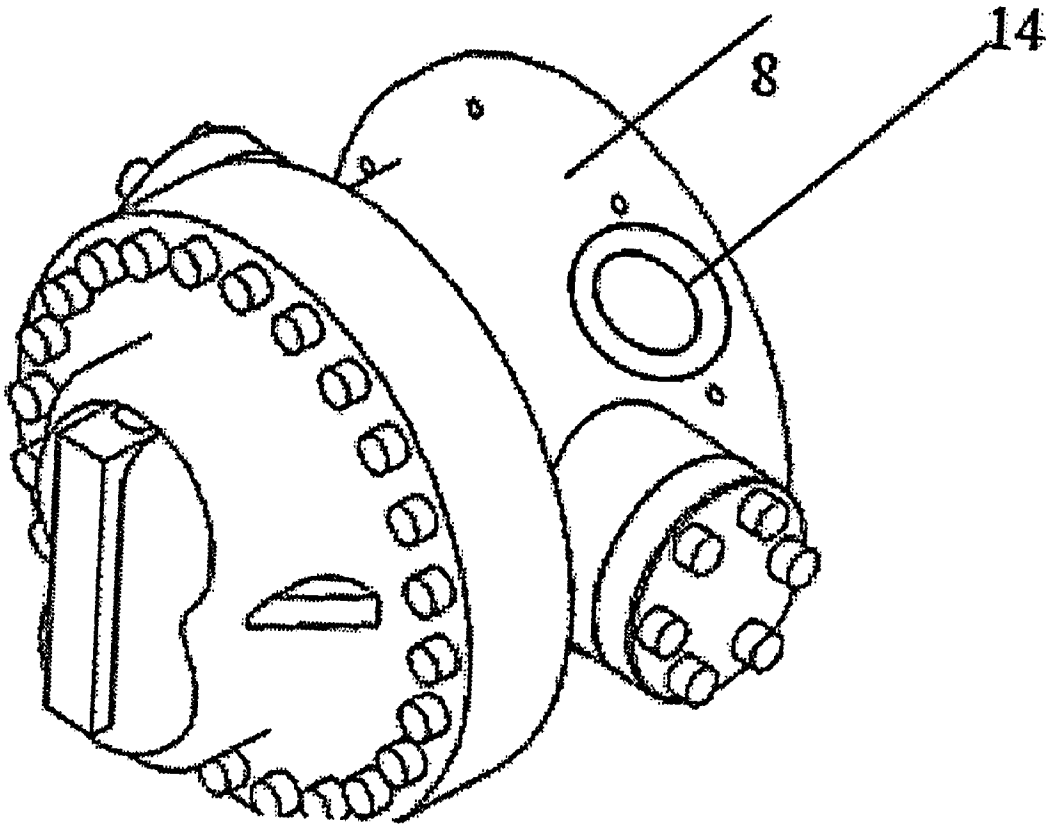
FIG. 3 shows the outer view of a screw compressor housing according to the invention.
Figure 4:
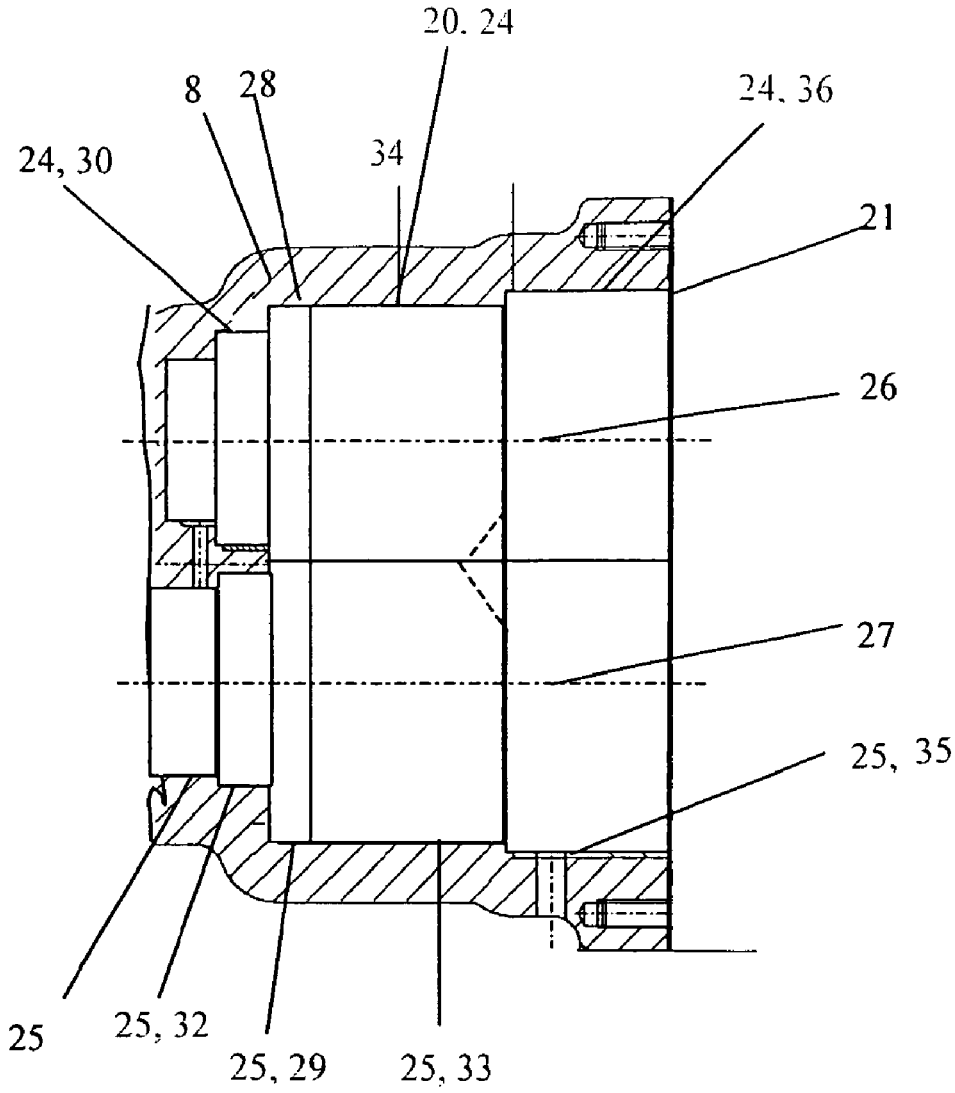
FIG. 4 shows a cut drawing of a screw compressor according to the invention.

FIG. 3 shows economizer connection 14 at the housing 8.

DETAILED DESCRIPTION OF THE INVENTION

The figure shows a screw compressor according to the invention for compression of a working fluid to a discharge pressure of 160 bar featuring two rotors, a male rotor 1 and a female rotor 2 with the male rotor 1 having a drive-shaft end 3, and both rotors are enclosed in a housing 8 featuring an inlet port 7, located in control plates 18 at male rotor side and located in control plates 19 at female rotor side for passing of the working fluid into the interlobe spaces of the rotor pair and an outlet port, not shown, for forcing the gas out of the interlobe spaces of the rotor pair due to rotation of the rotors, and having an economizer port 14 for superfeeding of working fluid into interlobe spaces. The screw compressors according to the present invention are made for extremely high discharge pressures up to 160 bar. The housing section 8, which encloses the profile section 12 of the male rotor 1 and profile section 13 female rotor 2, is cup-shaped. The female rotor outer diameter 15 of the profile of the female rotor 2 and the male rotor outer diameter 16 of the profile of the male rotor 1 are shown in FIG. 2. The adjacent outer diameters of the parts arranged in this housing section decrease when going from the open end 21 to the opposite closed end of the housing section 8. The parts supporting flange 10, male rotor 1 and female rotor 2 with their profile section are mountable from open end 21 of the housing section 8.

The profile sections of the rotors have a length 17 as is shown in FIG. 2. The profile sections of the rotors have shaft shoulders 4 enclosed in radial bearings 44, 47 and in radial bearings 9. Resulting axial forces are being supported by axial bearings 6.

The supporting flanges 10 adjacent to the radial bearings are guided at their periphery in the housing 8 so that there will arise no coaxial deviations caused by assembly. Outer races of the radial bearings can directly adjoin the housing 8 or outer races of the radial bearings can tight-fittingly adjoin concentric supporting flanges.

The supporting flanges 10 are axially fixed by the end housing 11.

Bearings and supporting flanges are arranged on two parallel axes of the housing section 8, one axis belongs to the male rotor side, the second axis belongs to the female rotor side.

The geometrical centers of all coaxial holes 25 in the cup shaped housing on the male rotor side, are located at one straight line 27. This allows arrangement and assembling of radial bearings 9 and their supporting flanges 10 and radial bearings 44 at the suction side on the male rotor side, control plate 18 without coaxial deviations.

The geometrical center of all coaxial holes 24 in the cup-shaped housing on the female rotor side, are located on one straight line 26. This allows arrangement and assembling of radial bearings 9 and their supporting flanges 10 and radial bearings 47 at the suction side on the female rotor side and control plate 19 without coaxial deviations.

The hole diameter 20 of the housing 8 at the area of the profile section of the female rotor, is larger than the outer diameter of the profile section of the female rotor 15. The hole diameter 28 of the housing 8 at the surrounding area of control plate 19 at the female rotor side is smaller than the hole diameter 20 of the housing 8 at the area of profile section female rotor side.

Housing diameter execution on the male rotor side is related to the hole diameters located in the housing analogues as described for the female rotor side.

Due to this construction the bearings and the components adjacent to the bearings are guided at their periphery in one housing section so that there will be no coaxial deviations caused by assembly and no coaxial deviations in long term operation.

Regarding FIG. 2, the wrap angle of male rotor 1 is about 100°. Caused by teeth ratio 5:6 between male and female teeth index angle between neighboring teeth of male rotor 1 is 72°. The rotor profile length 17 is short relative to the male rotor diameter 16.

In FIG. 3 is shown the economizer port 14 located on the part of the surroundings of the rotor pair.

A screw compressor for extremely high discharge pressures up to 160 bar is disclosed featuring a male rotor and a female rotor with the male rotor having a drive-shaft end, and both rotors are enclosed in a housing featuring an inlet port and an outlet port with profile sections of the rotors having shaft shoulders enclosed in radial bearings and with axial bearings arranged on shaft ends wherein geometrical centers of all coaxial holes at least for radial bearings and profile section, in one housing on a male rotor side, are located at one straight male line and geometrical centers of all coaxial holes in the same housing on a female rotor side, are located at one straight female line. Outer races of the radial bearings 44,47 directly adjoin the housing and the outer races of the radial bearings 9, 59 tight-fitting adjoin concentric supporting flanges 10.

The radial bearings or supporting flanges enclosing the radial bearings tight-fitting adjoin holes, the centers of which are arranged on the parallel axes of the housing, which correspond to the imaginary rotation axes of the rotors.

The housing is shaped in a manner such that the diameters of all coaxial holes in the housing on the male rotor side, and diameters of all coaxial holes in the housing at least for radial bearings support and profile section, on the female rotor side, decrease from the open to the closed end of the housing.

Outer races of the male bottom radial bearing 44 and of the female bottom radial bearing 47 directly adjoin the cup-shaped single piece housing section 8.

Outer races of the male top radial bearing 59 and the female top radial bearing 9 tight-fitting adjoin concentric supporting flanges 10.

The male bottom radial bearing 44 and the female bottom radial bearing 47 or supporting flanges 10 enclosing the male top radial bearing 59 and the female top radial bearing 9 tight-fitting adjoin the housing bores the centers of which are arranged on parallel axes of the cup-shaped single piece housing section 8, which correspond with imaginary rotation axes of the rotors 1, 2.

The male rotor and the female rotor are adapted to engage each other for passing the working fluid into cavities of the male rotor and of the female rotor and for compression of the working fluid to a discharge pressure of 120 bar.

The supporting flange is a concentric supporting flange forming together with the male top radial bearing and the female top radial bearing built-in components, wherein the built-in components enclosing the male rotor and the female rotor are arranged in the housing bores in the housing section.

The bottom radial bearings and the built-in components adjacent to the top radial bearings are guided at their periphery in the cup-shaped single piece housing section 8 so that no coaxial deviations are caused by assembly.

Adjacent diameters of housing bores arranged in the cup-shaped single piece housing section 8 increase when going from a closed end of the cup-shaped single piece housing section 8 to an open end of the cup-shaped single piece housing section 8. The housing bores are accessible from the open end of the cup-shaped single piece housing section 8. Bearings and supporting flanges are arranged on two parallel axes of the cup-shaped single piece housing section 8, wherein a male axis belongs to the male rotor 1 and wherein a female axis belongs to the female rotor 2.

Centers of circular peripheries of housing bores in the cup-shaped single piece housing section 8 on a male side are located on a male straight line 27, and centers of circular peripheries of bores in the cup-shaped single piece housing section 8 on a female side are located on a female straight line 26, and wherein the male straight line 27 and the female straight line 26 are disposed in parallel.

A screw compressor for extremely high discharge pressures up to 160 bar comprises a cup-shaped single piece housing section 8 having a bottom housing bore 30, 32; an inlet port 7 formed at the cup-shaped single piece housing section 8; a male bottom radial bearing 44 disposed on a male side in the bottom housing bore; a female bottom radial bearing 47 disposed on a female side in the bottom housing bore 30; a middle housing bore 29, 28 disposed in the housing section adjoining to the bottom housing bore and having a radial size larger than the bottom housing bore 30, 32; a control plate seated in the middle housing bore; a main housing bore 33, disposed in the housing section adjoining to the middle housing bore and having a radial size larger than the middle housing bore 29, 28; a male rotor 1 seated with a bottom end in the male bottom radial bearing 44 and having a shaft shoulder (4) circulating in a male opening of the control plate 18 and having a male profile section circulating in the main housing bore 33 next to the control plate 18; a female rotor 2 seated with a bottom end in the female bottom radial bearing 47 and having a shaft shoulder 4 circulating in a female opening of the control plate 19 and having a female profile section circulating in the main housing bore 20 next to the control plate 19 and engaging the male profile section; a top housing bore 35, 36 disposed in the housing section adjoining to the main housing bore 33, 20 and having a radial size larger than the radial size of the main housing bore 33, 20; a supporting flange 10 disposed in the top housing bore 35, 36, wherein the male rotor 1 has a top male shoulder 37 circulating in a male opening in the supporting flange and wherein the female rotor 2 has a top female shoulder 38 circulating in a female opening in the supporting flange; a male top radial bearing 59 disposed on a male side in the supporting flange, wherein the male rotor is seated with its top end in the male top radial bearing; a female top radial bearing 9 disposed on a female side in the supporting flange, wherein the female rotor is seated with its top end in the female top radial bearing; a male axial bearing 6 attached to the male top radial bearing, wherein the top end of the male rotor is seated on the male axial bearing; a female axial bearing 56 attached to the female top radial bearing, wherein the top end of the female rotor is seated on the female axial bearing; an outlet port 40 formed at the cup-shaped single piece housing section 8; and an end housing 11 attached to a top end of the cup-shaped housing.

A drive shaft end 3 can be furnished to the male rotor 1; a wrap angle of the male rotor 1 can be about 100 degrees; a teeth ratio between male and female teeth is 5:6; a teeth index angle 12 between neighboring teeth of the male rotor 1 is 72 degrees; and a rotor profile length 17 is short relative to a male rotor diameter.

A screw compressor for extremely high discharge pressures up to 160 bar can comprise a cup-shaped single piece housing section 8, wherein a closed end of the cup-shaped single piece housing section 8 corresponds to a suction-side, and having a bottom housing bore; an inlet port 7 formed at the cup-shaped single piece housing section 8; a male suction-side radial bearing 44 disposed on a male side in the bottom housing bore; a female suction-side radial bearing 47 disposed on a female side in the bottom housing bore; a middle housing bore 29, 28 disposed in the cup-shaped single piece housing section 8 adjoining to the bottom housing bore 30, 32 and having a radial size larger than a radial size of the bottom housing bore 30, 32; a control plate 18, 19 seated in the middle housing bore 29, 28; a male rotor 1 seated with a suction-side end in the male suction-side radial bearing 44 and having a suction-side shoulder 4 circulating in a male opening of the control plate and having a male profile section circulating in the main housing bore 33 next to the control plate 18; a female rotor 2 seated with a suction-side end in the female suction-side radial bearing 47 and having a suction-side shoulder 4 circulating in a female opening of the control plate and having a female profile section circulating in the main housing bore 20 next to the control plate 19 and engaging the male profile section; a main housing bore 33, 20 disposed in the cup-shaped single piece housing section 8 and adjoining to the middle housing bore 29, 28 and having a radial size larger than a radial size of the middle housing bore; a top housing bore 35, 36 disposed in the cup-shaped single piece housing section 8 and adjoining to the main housing bore and having a radial size larger than a radial size of the main housing bore; a supporting flange 10 disposed in the top housing bore 35, 36, wherein the male rotor 1 has a discharge-side male shoulder circulating in a male opening in the supporting flange 10 and wherein the female rotor 2 has a discharge-side female shoulder circulating in a female opening in the supporting flange 10; a male discharge-side radial bearing 59 disposed on a male side in the supporting flange 10, wherein the male rotor 1 is seated with its discharge-side end in the male discharge-side radial bearing 59; a female discharge-side radial bearing 9 disposed on a female side in the supporting flange 10, wherein the female rotor 2 is seated with its discharge-side end in the female discharge-side radial bearing 9; a male axial bearing 6 attached to the male discharge-side radial bearing 59, wherein the discharge-side end of the male rotor 1 is seated on the male axial bearing 6; a female axial bearing attached to the female discharge-side radial bearing 9, wherein the discharge-side end of the female rotor 2 is seated on the female axial bearing 6; an outlet port 40 formed at the cup-shaped single piece housing section 8; an end housing 11 attached to a discharge-side end of the cup-shaped single piece housing section 8.

The preceding screw compressor can further comprise a drive shaft end 3 furnished to the male rotor to be driven; wherein the male discharge side radial bearing is concentric arranged in the supporting flange 10; wherein the female discharge side radial bearing 9 is concentric arranged in the supporting flange 10; wherein the supporting flange 10 axially adjoins the end housing 11.

Alternatively, the screw compressor can have built-in components disposed adjacent to the male discharge-side radial bearing 59 and to the female discharge-side radial bearing 9 are concentric arranged in the supporting flange.

A screw compressor for extremely high discharge pressures up to 160 bar of a working fluid can comprise a male rotor 1 having a drive-shaft end 3; a female rotor 2; cavities formed by the male rotor 1 and the female rotor 2; a housing 8 enclosing the male rotor 1 and the female rotor 2; an inlet port 7 furnished at the housing 8 and connected for passing the working fluid into the cavities; an outlet port 40 for discharging gas out of the cavities due to rotation of the rotors 1, 2; a male profile section of the male rotor 1 and having shaft shoulders 4; a female profile section of the female rotor 2 and having shaft shoulders 4; radial bearings 44, 47 on a suction side enclosing the shaft shoulders 4; radial bearings 59, 9 on a discharge side enclosing the shaft shoulders 4; axial bearings 6, 56 attached to the radial bearings 59, 9 on the discharge side for supporting resulting axial forces; supporting flanges 10 disposed adjacent to the radial bearings and guided at their periphery in the housing 8 such that no coaxial deviations will arise caused by assembly; and an end housing 11 fixing the supporting flanges in axial direction.

The preceding screw compressor can further comprise a drive shaft end 3 furnished to the male rotor 1; wherein a wrap angle of the male rotor 1 is about 100 degrees; wherein a teeth ratio between male and female teeth is 5:6; wherein a teeth index angle between neighboring teeth of the male rotor 1 is 72 degrees; and wherein a rotor profile length 17 is short relative to a male rotor diameter.

LIST OF REFERENCE NUMERALS USED

1 Male rotor
2 Female rotor
3 Drive-shaft end
4 Shaft shoulders
6 Male axial bearing
7 Inlet port
8 Housing
9 Female top radial bearing
10 Concentric supporting flanges
11 End housing
12 Profile section male rotor
13 Profile section female rotor
14 Economizer port
15 Female rotor outer diameter of profile section
16 Male rotor outer diameter of profile section
17 Length of profile section
18 Control plate male rotor side
19 Control plate female rotor side
20 Housing hole diameter at profile section, female rotor side
21 Open end side of housing
24 Coaxial holes on female rotor side
25 Coaxial holes on male rotor side
26 Line female rotor side
27 Line male rotor side
28 Hole diameter of the housing at the area of control plate at female rotor side
29 Middle housing bore at male rotor side
30 Bottom housing bore at female rotor side
32 Bottom housing bore at male rotor side
33 Main housing bore at male rotor side
34 Main housing bore at female rotor side
35 Top housing bore at male rotor side
36 Top housing bore at female rotor side
37 Top male shoulder
38 Top female shoulder
44 Male rotor bottom radial bearing
47 Female rotor bottom radial bearing
56 Female axial bearing
59 Male top radial bearing

What we claim is:

1. A screw compressor for extremely high discharge pressures up to 160 bar featuring two rotors, a male rotor and a female rotor with the male rotor having a drive-shaft end, and both rotors are enclosed in a housing featuring an inlet port and an outlet port with profile sections of the rotors having shaft shoulders enclosed in radial bearings and with axial bearings arranged on shaft ends wherein geometrical centers of all coaxial holes at least for radial bearings and profile section, in one housing on a male rotor side, are located at one straight male line and geometrical centers of all coaxial holes in the same housing on a female rotor side, are located at one straight female line.

2. The screw compressor according to claim 1 wherein outer races of the radial bearings (44, 47) directly adjoin the housing.

3. The screw compressor according to claim 1 wherein outer races of the radial bearings (44, 47) tight-fitting adjoin concentric supporting flanges.

4. The screw compressor according to claim 1 wherein radial bearings or supporting flanges enclosing the radial bearings tight-fitting adjoin holes, the centers of which are arranged on the parallel axes of the housing, which correspond with the imaginary rotation axes of the rotors.

5. The screw compressor according to claim 1 wherein the housing is shaped in a manner such that the diameters of all coaxial holes in the housing on the male rotor side, and diameters of all coaxial holes in the housing at least for radial bearings support and profile section, on the female rotor side, decrease from the open to the closed end of the housing.

6. A screw compressor for extremely high discharge pressures up to 160 bar comprising a cup-shaped single piece housing section (8) having a bottom housing bore (30, 32);

an inlet port (7) formed at the cup-shaped single piece housing section (8);

a male rotor bottom radial bearing (44) disposed on a male side in the bottom housing bore (32);

a female rotor bottom radial bearing (47) disposed on a female side in the bottom housing bore (30);

a middle housing bore (29, 28) disposed in the housing section adjoining to the bottom housing bore and having a radial size larger than the bottom housing bore (30, 32);

a control plate seated in the middle housing bore;

a main housing bore (33, 20) disposed in the housing section adjoining to the middle housing bore and having a radial size larger than the middle housing bore (29, 28);

a male rotor (1) seated with a bottom end in the male bottom radial bearing (44) and having a shaft shoulder (4) circulating in a male opening of the control plate (18) and having a male profile section circulating in the main housing bore (33) next to the control plate (18);

a female rotor (2) seated with a bottom end in the female bottom radial bearing (47) and having a shaft shoulder (4) circulating in a female opening of the control plate (19) and having a female profile section circulating in the main housing bore (20) next to the control plate (19) and engaging the male profile section;

a top housing bore (35, 36) disposed in the housing section adjoining to the main housing bore (33, 20) and having a radial size larger than the radial size of the main housing bore (33, 20);

a supporting flange (10) disposed in the top housing bore (35, 36), wherein the male rotor (1) has a top male shoulder (37) circulating in a male opening in the supporting flange and wherein the female rotor (2) has a top female shoulder (38) circulating in a female opening in the supporting flange;

a male top radial bearing (59) disposed on a male side in the supporting flange, wherein the male rotor is seated with its top end in the male top radial bearing;

a female top radial bearing (9) disposed on a female side in the supporting flange, wherein the female rotor is seated with its top end in the female top radial bearing;

a male axial bearing (6) attached to the male top radial bearing, wherein the top end of the male rotor is seated on the male axial bearing;

a female axial bearing (56) attached to the female top radial bearing, wherein the top end of the female rotor is seated on the female axial bearing;

an outlet port (40) formed at the cup-shaped single piece housing section (8);

an end housing (11) attached to a top end of the cup-shaped housing.

7. The screw compressor according to claim 6 wherein outer races of the male bottom radial bearing (44) and of the female bottom radial bearing (47) directly adjoin the cup-shaped single piece housing section (8).

8. The screw compressor according to claim 6 wherein outer races of the male top radial bearing and the female top radial bearing (9) tight-fitting adjoin concentric supporting flanges (10).

9. The screw compressor according to claim 6 wherein the male bottom radial bearing (44) and the female bottom radial bearing (47) or supporting flanges enclosing the male top radial bearing and the female top radial bearing tight-fitting adjoin the housing bores the centers of which are arranged on parallel axes of the cup-shaped single piece housing section (8), which correspond with imaginary rotation axes of the rotors (1, 2).

10. The screw compressor according to claim 6 wherein the male rotor and the female rotor are adapted to engage each other for passing the working fluid into cavities of the male rotor and of the female rotor and for compression of the working fluid to a discharge pressure of 120 bar.

11. The screw compressor according to claim 6 wherein the supporting flange is a concentric supporting flange forming together with the male top radial bearing and the female top radial bearing built-in components, wherein the built-in components enclosing the male rotor and the female rotor are arranged in the housing bores in the housing section.

12. The screw compressor according to claim 11 wherein the bottom radial bearings and the built-in components adjacent to the top radial bearings are guided at their periphery in the cup-shaped single piece housing section (8) so that no coaxial deviations are caused by assembly.

13. The screw compressor according to claim 6, wherein adjacent diameters of housing bores arranged in the cup-shaped single piece housing section (8) increase when going from a closed end of the cup-shaped single piece housing section (8) to an open end of the cup-shaped single piece housing section (8), and wherein the housing bores are accessible from the open end of the cup-shaped single piece housing section (8), and wherein bearings and supporting flanges are arranged on two parallel axes of the cup-shaped single piece housing section (8), wherein a male axis belongs to the male rotor (1) and wherein a female axis belongs to the female rotor (2).

14. The screw compressor according to claim 6, wherein centers of circular peripheries of housing bores in the cup-shaped single piece housing section (8) on a male side are located on a male straight line (27), and wherein centers of circular peripheries of bores in the cup-shaped single piece housing section (8) on a female side are located on a female straight line (26), and wherein the male straight line (27) and the female straight line (26) are disposed in parallel.

15. The screw compressor according to claim 6 further comprising a drive shaft end (3) furnished to the male rotor (1);

wherein a wrap angle of the male rotor (1) is about 100 degrees;

wherein a teeth ratio between male and female teeth is 5:6;

wherein a teeth index angle between neighboring teeth of the male rotor (1) is 72 degrees; and wherein a rotor profile length (17) is short relative to a male rotor diameter.

16. A screw compressor for extremely high discharge pressures up to 160 bar comprising a cup-shaped single piece housing section (8), wherein a closed end of the cup-shaped single piece housing section (8) corresponds to a suction-side, and having a bottom housing bore;

an inlet port (7) formed at the cup-shaped single piece housing section (8);

a male suction-side radial bearing (44) disposed on a male side in the bottom housing bore;

a female suction-side radial bearing (47) disposed on a female side in the bottom housing bore;

a middle housing bore (29, 28) disposed in the cup-shaped single piece housing section (8) adjoining to the bottom housing bore (30, 32) and having a radial size larger than a radial size of the bottom housing bore (30, 32);

a control plate (18, 19) seated in the middle housing bore (29, 28);

a male rotor (1) seated with a suction-side end in the male suction-side radial bearing (44) and having a suction-side shoulder (4) circulating in a male opening of the control plate and having a male profile section circulating in the middle housing bore (29) next to the control plate (18);

a female rotor (2) seated with a suction-side end in the female suction-side radial bearing (47) and having a suction-side shoulder (4) circulating in a female opening of the control plate and having a female profile section circulating in the middle housing bore (28) next to the control plate (19) and engaging the male profile section;

a main housing bore (33, 20) disposed in the cup-shaped single piece housing section (8) and adjoining to the middle housing bore (29, 28) and having a radial size larger than a radial size of the middle housing bore;

a top housing bore (35, 36) disposed in the cup-shaped single piece housing section (8) and adjoining to the main housing bore and having a radial size larger than a radial size of the main housing bore;

a supporting flange (10) disposed in the top housing bore (35, 36), wherein the male rotor (1) has a discharge-side male shoulder circulating in a male opening in the supporting flange (10) and wherein the female rotor (2) has a discharge-side female shoulder circulating in a female opening in the supporting flange (10);

a male discharge-side radial bearing (59) disposed on a male side in the supporting flange (10), wherein the male rotor (1) is seated with its discharge-side end in the male discharge-side radial bearing (59);

a female discharge-side radial bearing (9) disposed on a female side in the supporting flange (10), wherein the female rotor (2) is seated with its discharge-side end in the female discharge-side radial bearing (9);

a male axial bearing (6) attached to the male discharge-side radial bearing, wherein the discharge-side end of the male rotor (1) is seated on the male axial bearing (6);

a female axial bearing (56) attached to the female discharge-side radial bearing, wherein the discharge-side end of the female rotor (2) is seated on the female axial bearing (56);

an outlet port (40) formed at the cup-shaped single piece housing section (8);

an end housing (11) attached to a discharge-side end of the cup-shaped single piece housing section (8).

17. The screw compressor according to claim 16 further comprising a drive shaft end (3) furnished to the male rotor to be driven;

wherein the male discharge side radial bearing is concentric arranged in the supporting flange (10);

wherein the female discharge side radial bearing is concentric arranged in the supporting flange (10);

wherein the supporting flange (10) axially adjoins the end housing (11).

18. The screw compressor according to claim 16, wherein built-in components disposed adjacent to the male discharge radial bearing (59) and to the female discharge radial bearing (9) are concentric arranged in the supporting flange.

19. A screw compressor for extremely high discharge pressures up to 160 bar of a working fluid comprising a male rotor (1) having a drive-shaft end (3);

a female rotor (2);

cavities formed by the male rotor (1) and the female rotor (2);

a housing (8) enclosing the male rotor (1) and the female rotor (2);

an inlet port (7) furnished at the housing (8) and connected for passing the working fluid into the cavities;

an outlet port (40) for discharging gas out of the cavities due to rotation of the rotors (1, 2);

a male profile section 12 of the male rotor (1) and having shaft shoulders (4);

a female profile section 13 of the female rotor (2) and having shaft shoulders (4);

radial bearings (44, 47) on a suction side enclosing the shaft shoulders (4);

radial bearings (59, 9) on a discharge side enclosing the shaft shoulders (4);

axial bearings (6, 56) attached to the radial bearings (59, 9) on the discharge side for supporting resulting axial forces;

supporting flanges (10) disposed adjacent to the radial bearings and guided at their periphery in the housing (8) such that no coaxial deviations will arise caused by assembly;

an end housing (11) fixing the supporting flanges in axial direction.

20. The screw compressor according to claim 19 further comprising a drive shaft end (3) furnished to the male rotor (1);

wherein a wrap angle of the male rotor (1) is about 100 degrees;

wherein a teeth ratio between male and female teeth is 5:6;

wherein a teeth index angle between neighboring teeth of the male rotor (1) is 72 degrees; and wherein a rotor profile length (17) is short relative to a male rotor diameter.

* * * * *